US007108595B2

(12) United States Patent
Reisinger

(10) Patent No.: US 7,108,595 B2
(45) Date of Patent: Sep. 19, 2006

(54) APPARATUS FOR MANUAL SHARPENING OF THE BLADES OF CUTTING TOOLS

(76) Inventor: Georg F. Reisinger, In der Au 2a, 91183 Abenberg (DE)

( * ) Notice: Subject to any disclaimer, the term of this patent is extended or adjusted under 35 U.S.C. 154(b) by 0 days.

(21) Appl. No.: 11/012,261

(22) Filed: Dec. 16, 2004

(65) Prior Publication Data

US 2006/0009138 A1 Jan. 12, 2006

(30) Foreign Application Priority Data

Mar. 11, 2004 (DE) ..... 10 2004 012 317

(51) Int. Cl.
*B24B 23/00* (2006.01)

(52) U.S. Cl. ..... 451/461; 451/463; 451/555

(58) Field of Classification Search ..... 451/461, 451/555, 502, 45, 463, 470, 484, 485, 486
See application file for complete search history.

(56) References Cited

U.S. PATENT DOCUMENTS

| | | | | |
|---|---|---|---|---|
| 22,919 | A * | 2/1859 | Hinman | 76/86 |
| 562,223 | A | 6/1896 | Hausse | |
| 584,933 | A | 6/1897 | Friedrich | |
| 1,041,631 | A * | 10/1912 | Johnson | 451/486 |
| 1,573,875 | A * | 2/1926 | Shaw | 76/88 |
| 2,454,035 | A * | 11/1948 | Clark | 451/486 |
| 4,550,632 | A * | 11/1985 | Inman | 76/86 |
| 4,599,919 | A | 7/1986 | Fortenberry | |
| 4,624,079 | A | 11/1986 | Bonapace | |
| 5,440,953 | A * | 8/1995 | Gangelhoff et al. | 76/86 |
| 6,393,946 | B1 | 5/2002 | Kenesky et al. | |
| D499,323 | S * | 12/2004 | Smith | D8/90 |

FOREIGN PATENT DOCUMENTS

| | | |
|---|---|---|
| DE | 202 03 955 U1 | 6/2002 |
| GB | 505871 | 5/1939 |

* cited by examiner

*Primary Examiner*—Jacob K. Ackun, Jr.
(74) *Attorney, Agent, or Firm*—Jean C. Edwards, Esq.; Akerman Senterfitt

(57) ABSTRACT

An apparatus for the manual sharpening of blades of cutting tools, includes at least two sharpening elements each with at least one sharpening edge, wherein the sharpening elements can be disposed to be partially overlapping, and partially in contact with each other, such that in a first state, one sharpening edge of each of the first and the second sharpening elements defines a first and a second currently used sharpening edge, respectively, and these sharpening edges cross one another at a crossing point and form a V-shaped gap with an angle, into which the cutting tool blade is inserted. The first and second sharpening elements can be shifted with respect to each other while maintaining the angle, such that the crossing point is shifted along the first and/or second currently used sharpening edge, and the at least positionings of the sharpening elements with respect to one another are reversibly fixed.

17 Claims, 4 Drawing Sheets

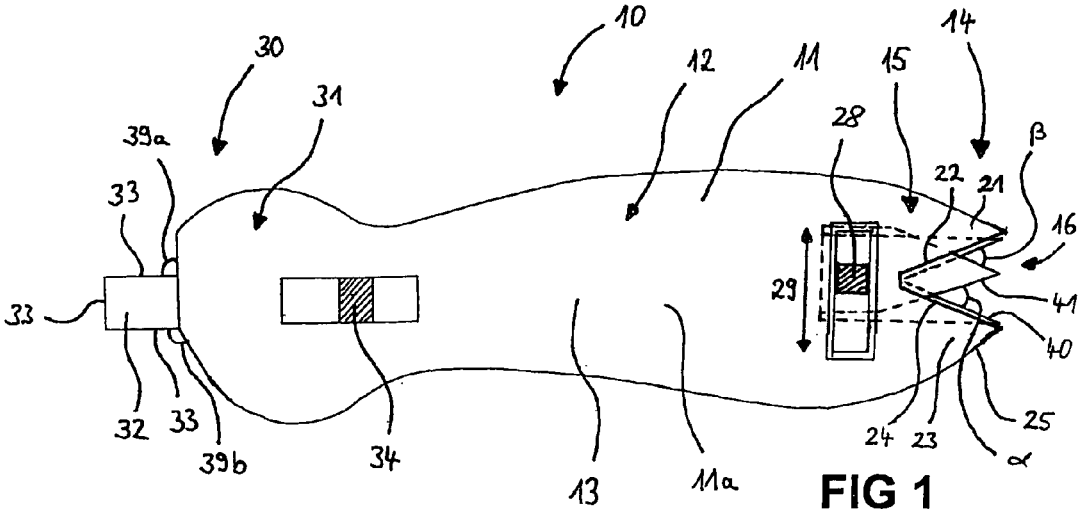
FIG 1
FIG 1a
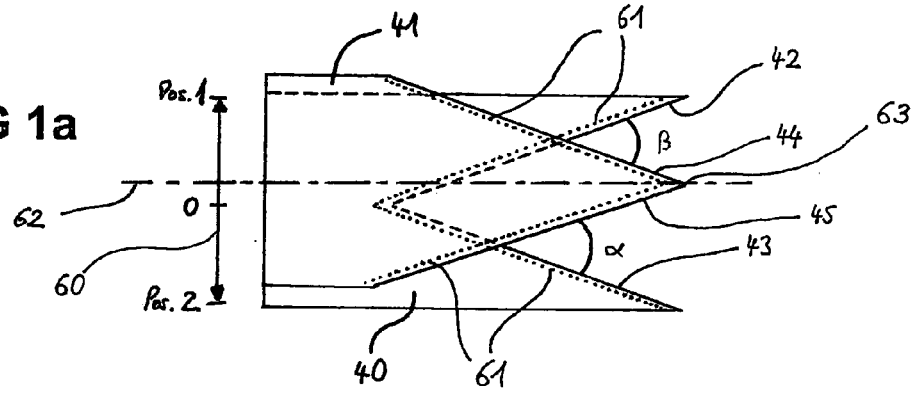
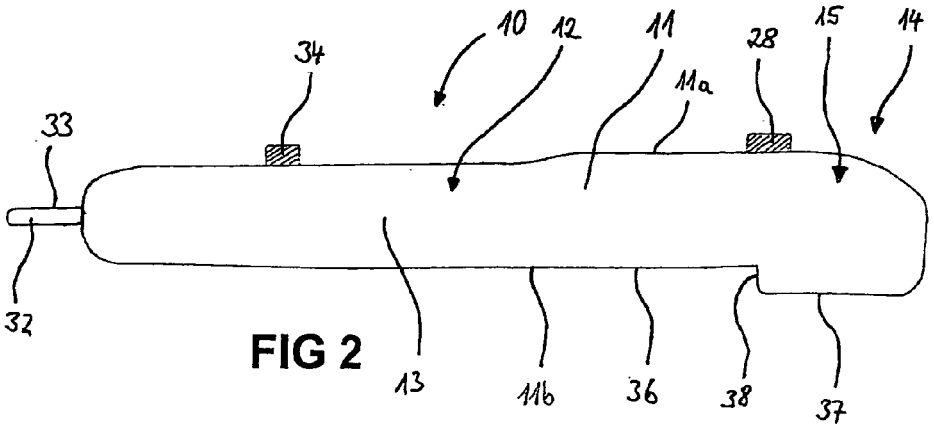
FIG 2

APPARATUS FOR MANUAL SHARPENING OF THE BLADES OF CUTTING TOOLS

BACKGROUND OF THE INVENTION

1. Field of the Invention

This invention relates to an apparatus for manually sharpening the blades of cutting tools, in particular, knives or scissors.

2. Description of Related Art

Various forms of apparatuses having two sharpening elements allowing both sides of a blade to be processed, and thereby sharpened, simultaneously, are already known.

For instance, the patents DE 202 03 955 U1 and U.S. Pat. No. 4,599,919 provide for a sharpening apparatus in which two crossed sharpening elements (plates of hard metal) form a V-shaped gap for sharpening. The processing angle formed by the V-shaped gap in these cases is permanently predetermined. The hard-metal plates in DE 202 03 955 U1 have a basic rectangular shape, whereas in U.S. Pat. No. 4,599,919 the basic shape of the sharpening elements includes a triangular tip at one end. In both of these documents the two sharpening elements of the apparatus have the same shape as one another, each with two sharpening edges. This configuration makes it possible to exchange the sharpening elements for one another so as to employ the other sharpening edge of each of them, which increases the working life if the sharpening elements.

A disadvantageous feature of these constructions, however, is that the sharpening process always occurs at the same place on whichever sharpening edges are operative, so that this site rapidly becomes worn down. According to DE 202 03 955 U1, all that can be done is to make a second edge site usable by rotating the sharpening elements through 180° and exchanging their positions.

It is known from U.S. Pat. Nos. 562,223, 584,933 and 6,393,946 B1 to dispose the sharpening elements so that they can be rotated about an axis and fixed in selected positions within the sharpening apparatus. By appropriate choice or adjustment of the rotational position of the sharpening elements, the sharpening edges can be set at the desired angle for processing the blades. In this arrangement, a different site on the sharpening edges is used for sharpening, depending on the selected angle. For a given angle, however, it is always the same edge site that is used, and since in practice such an apparatus is often used repeatedly for blades of the same kind, rapid wear results. To prolong the working life, these documents disclose only that each of the sharpening elements comprises several sharpening edges, which can be employed in succession by appropriate repositioning of the cutting element.

The patent GB 505,871 furthermore, discloses a sharpening apparatus in which the operative site on each sharpening edge depends on the pressure with which the knife to be sharpened presses against the edge, and on the opposing force generated when the user presses the parts of a handle together. Here it is disadvantageous that the relative position of the two sharpening elements cannot be fixed, so that the effective sharpening region varies continuously and is determined only at random.

Accordingly, a sharpening apparatus which overcomes these disadvantages, is desired.

SUMMARY OF THE INVENTION

The present invention relates to an apparatus, having two sharpening elements, for the manual sharpening of the blades of cutting tools, in particular, knives and/or scissors, the arrangement of which provides for simultaneous sharpening, thereby avoiding the unsatisfactory sharpening that is frequently obtained with only a single sharpening element.

One objective of the present invention is an apparatus for manual sharpening in which the working life of the sharpening elements is distinctly increased, and the result of the sharpening is also optimized over a longer period of use.

The present invention relates to an apparatus for manually sharpening the blades of cutting tools, in particular knives and/or scissors, and includes at least one first sharpening element with at least one sharpening edge, and at least one second sharpening element with at least one sharpening edge, wherein the first sharpening element and the second sharpening element can be or are arranged so as to be partially overlapping, in particular partially in contact with one another, such that when the apparatus is in a first state, one sharpening edge of the first sharpening element defines a first currently used sharpening edge while one sharpening edge of the second sharpening element defines a second currently used sharpening edge, and the first currently used sharpening edge and second currently used sharpening edge cross one another at a crossing point and form a V-shaped gap with an angle $\alpha$ at the crossing point, into which the blades of the cutting tool that is to be sharpened are inserted.

The apparatus of the present invention for manual sharpening, includes a first sharpening element and a second sharpening element which can be shifted with respect to one another while preserving the angle $\alpha$, in such a way that the crossing point shifts along the first currently used sharpening edge and the second currently used sharpening edge, and/or along the second currently used sharpening edge. The sharpening elements in this embodiment are or can be reversibly fixed in two or more positions relative to one another.

The purpose of this arrangement of two sharpening elements is to allow both sides of a blade to be processed, and thereby sharpened, simultaneously. This avoids the unsatisfactory sharpening that is frequently obtained with only a single sharpening element because the blades to be sharpened are positioned at the wrong angle.

It is thus the objective of the present invention to disclose an apparatus for manual sharpening in which the working life of the sharpening elements is distinctly increased and the result of the sharpening is also optimized over a longer period of use.

This objective is achieved in accordance with the invention by a apparatus for manual sharpening wherein the first sharpening element and the second sharpening element can be shifted with respect to one another while preserving the angle $\alpha$, in such a way that the crossing point shifts along the first currently used sharpening edge and/or the second currently used sharpening edge, and that the sharpening elements are or can be reversibly fixed in two or more specific positions relative to one another.

"Fixation" of the sharpening elements, which are in principle displaceable with respect to one another, should be understood to mean that the sharpening elements do not become relatively displaced when a blade to be sharpened is applied thereto and processed, but rather stay in the previously positioned orientation.

The advantage achieved by the invention resides in particular in the fact that because of the mutual displaceability of the sharpening elements, a large region of the sharpening edges, or nearly their entire length, is made available for sharpening blades. The site to be operative at any time can thus be specifically selected and this selected positioning of the sharpening elements relative to one another can be maintained. In this way, it becomes possible to establish a particular positioning and thus employ a particular place on the sharpening edges until they become worn at that place, and subsequently to select a new positioning and hence a new site for sharpening along the sharpening edges. Such repositioning continues to be possible until the entire region of the sharpening edges that can be made accessible by shifting the elements has been worn down. As a result, the working life of the sharpening elements becomes many times longer than that obtained according to the state of the art, in which only one or only a few sites on the sharpening edges are used for processing. Furthermore, even after the sharpening elements have been used for a long time an optimal result of the sharpening process can be achieved, because at all times previously unused or, in some cases, only slightly used sites on the sharpening edges can be selected for the operation, by appropriately shifting the sharpening elements.

Another crucial advantage is that the angle $\alpha$ between the sharpening edges, and hence the angle for processing of the blades to be sharpened, remains constant when the sharpening elements are shifted, so that optimal sharpening is always possible immediately, without readjustment.

In this apparatus, because of the geometric arrangement and mobility of the sharpening elements, the processing angle also varies (although only to a slight degree) when the sharpening elements are in different relative positions.

Furthermore, the fact that the sharpening elements can be shifted enables the depth of the gap between the sharpening edges in current use to be varied. For instance, when the elements are shifted so as to make the gap shallower, the sharpening edges become accessible even to broad blades such as that of an axe, so that such blades can also be sharpened.

According to one embodiment of the invention the apparatus can be constructed as a hand tool, i.e., not a stationary machine but rather a versatile and portable apparatus that can be used while simply held in the hand.

An especially advantageous embodiment of the apparatus in accordance with the invention provides that at least one sharpening edge of the first sharpening element and/or at least one sharpening edge of the second sharpening element are/is rectilinear, over at least part of its length. This feature makes it particularly simple to maintain the angle $\alpha$ when the sharpening elements are shifted relative to one another.

Another advantageous variant of the apparatus in accordance with the invention provides that at least one sharpening edge of the first sharpening element and at least one sharpening edge of the second sharpening element are ground so as to form a relief angle. In particular, all sharpening edges of the first and the second sharpening elements are relief-ground edges. "Relief grinding" should be understood to mean that the side surfaces of the sharpening elements that are adjacent to the relevant sharpening edges are slanted. The relief angle of a surface so shaped, i.e., the angle by which the surface is tilted away from 90°, is preferably in the range of 4° to 10°. The arrangement with respect to one another of sharpening elements provided with relief-ground sharpening edges is preferably such that the relief-ground sharpening edges of both sharpening elements that are operative during a sharpening process face toward a predicted direction of movement of a blade to be sharpened.

A useful further development of the invention provides that the apparatus includes a case within which the first sharpening element and the second sharpening element are or can be disposed, such that the first sharpening element and/or the second sharpening element can be shifted relative to the case, and such that two or more positionings of the sharpening elements relative to one another are or can be reversibly fixed within the case.

Here, again, "fixation" of the, in principle, displaceable sharpening elements should be understood to mean that the sharpening elements do not become relatively displaced when a blade to be sharpened is applied thereto and processed, but rather stay in the previously positioned orientation.

The provision of a case of this kind makes the invention useful on an everyday basis. The case allows the shiftability and fixation of the sharpening elements to be implemented in a simple manner. Furthermore, the components of the apparatus can be disposed at least partially within the case, so that there is less risk that a user will be injured. In addition, by designing the case appropriately, for instance as a shaft- or handle-like structure, the apparatus can be made easy for a user to manipulate.

According to one advantageous embodiment, a display means is provided to indicate the positioning of the first and/or the second sharpening element in or on the case. As a result, even when the sharpening elements are at least partially concealed by the case, the selected positioning of the first and/or the second sharpening element can be discerned at any time by a user.

The first sharpening element and/or the second sharpening element can, according to a first embodiment of the apparatus in accordance with the invention, have the shape of an ingot. Here the term "ingot" is used to mean an angular bar, the side surfaces of which are slanted, i.e., an originally rectangular bar with relief-grinding.

In this embodiment it can, in particular, be provided that the first sharpening element and/or the second sharpening element can be shifted within the case in a direction parallel to the element's first currently used sharpening edge or second currently used sharpening edge. This shiftability makes it possible to select and alter, in a targeted manner, the section of the particular sharpening edge that is to be employed, and this can be done separately for each of the two sharpening edges in current use. The size of the angle $\alpha$ between the sharpening edges, which is a crucial parameter for an optimal sharpening process, is not changed thereby.

According to an alternative second embodiment of the apparatus in accordance with the invention, the first sharpening element and/or the second sharpening element have/has at least at one end the shape of a prism or an arrowhead, with a triangle as the basic surface. This category is meant to include all embodiments that are either constructed in their entirety as a prism or arrowhead with triangular basic surface, or consist of at least two regions, at least one of which in itself, forms a prism or arrowhead with triangular basic surface. The second region could, for example, have the form of a rectangular bar or an ingot. In this last variant, the sharpening edges are preferably disposed in the prismatic or arrowhead-shaped region.

Here the term "prism" is used to denote a body with two parallel basic surfaces connected to one another by side surfaces. In this case the side surfaces are preferably slanted, i.e., they exhibit a relief angle. "Arrowhead" should be understood to mean a body with two basic surfaces connected by side surfaces so that the basic surfaces are tilted with respect to one another, in such a way that the distance between the basic surfaces is minimal at one corner of the body. Here, again, it is preferable for the side surfaces to be slanted, i.e., constructed with a relief angle.

According to an alternative third embodiment of the apparatus in accordance with the invention, it is provided that the first sharpening element has a three-dimensional M shape and/or the second sharpening element has at least at one end the shape of a prism or an arrowhead, with a triangle as the basic surface. The term "three-dimensional M shape" should be understood to designate a sharpening element with an M-shaped basic surface. In this case as well, the sharpening side surfaces are preferably slanted, i.e. provided with relief-grinding.

In all embodiments it can advantageously be provided that the first sharpening element and/or the second sharpening element can be shifted substantially in parallel to a line defined by two outer points, disposed opposite the crossing point, that delimit the V-shaped gap. This ability to be shifted makes it possible to specifically select and alter the operative section of the sharpening edge, along the length of the cutting edge currently in use, and thus to make use of at least some additional regions of the sharpening edges of the sharpening elements. In this case, again, shifting causes no change in the magnitude of the angle $\alpha$ between the sharpening edges.

In a further development of the apparatus in accordance with the invention it is provided that the first sharpening element and the second sharpening element each comprise at least one additional sharpening edge, which in particular is at least partially rectilinear, and that the apparatus can be put into a second state, which differs from the first state in that the additional sharpening edge of the first sharpening element constitutes the first currently used sharpening edge and the additional sharpening edge of the second sharpening element constitutes the second currently used sharpening edge, and the V-shaped gap forms an angle $\beta$ at the crossing point.

This embodiment of the apparatus in accordance with the invention makes it possible to use two sharpening edges of each of the two sharpening elements.

In particular in the third embodiment described above, in which the first sharpening element has a three-dimensional M shape, but also in other embodiments, it is provided according to a further development that in the apparatus the first state and the second state are available simultaneously (i.e., in parallel), in particular when the sharpening elements are in an intermediate position with respect to one another. Then the apparatus comprises two active pairs of sharpening edges, with which a blade to be sharpened can be processed.

According to a further development, it is provided that a transition between the first and second states is brought about by shifting the first and/or the second sharpening element. This design of the apparatus in accordance with the invention makes it possible to use two sharpening edges of each of the two sharpening elements by simply shifting those elements, with no need to open the apparatus, remove the sharpening elements and reinstall them in different positions. This again doubles the useful lifetime of the apparatus that can be achieved without reconstruction.

Another embodiment of the apparatus in accordance with the invention provides that the triangle formed by the basic surface in at least one of the sharpening elements is an isosceles triangle. Alternatively, or in addition, it can be provided that the triangle in the case of at least one of the sharpening elements is not an isosceles triangle.

Furthermore, the size of the angle $\alpha$ can correspond substantially to the size of the angle $\beta$. Alternatively, however, the size of the angle $\alpha$ can differ from that of the angle $\beta$. In the first case the apparatus can be used in the first and in the second state for sharpening blades of the same kind, i.e., blades having cutting-edge angles within the same angular bandwidth. In the second case, the apparatus is suitable for sharpening blades in two categories; that is, when in the first state it can sharpen blades with cutting-edge angles in a first angular bandwidth, and in the second state it can sharpen blades with edge angles in a second bandwidth that differs from the first. Hence by simply shifting the sharpening elements—i.e., with no further reconstruction necessary—two different groups of blades can be sharpened with a given apparatus.

Different angles $\alpha$ and $\beta$ likewise enable sharpening of blades with two phases, known as "shaping". Such blades have side surfaces set at two different angles in different sections. In the section directly adjacent to the cutting edge (the second phase), a larger angle is formed than in the section further away (first phase). This construction increases the stability of the blade.

The apparatus in accordance with the invention thus, in the embodiment presented here, enables correct sharpening of two-phase blades when appropriate angles are provided in the first and second states. For example, the first phase can be sharpened with the sharpening apparatus in its first state. If necessary, the apparatus can then be converted to its second state by shifting the sharpening elements, whereupon the second phase of the blade is sharpened with the sharpening apparatus in its second state.

When the angles $\alpha$ and $\beta$ are the same size, they can both lie, e.g., in the range from 10° to 50°, in particular about 20° or about 40°. When they are of different sizes, the angle $\alpha$ can for example, be in the range from 30° to 50°, in particular about 40°, and/or the angle $\beta$ in the range from 10° to 30°, in particular about 20°.

An advantageous embodiment of the sharpening apparatus in accordance with the invention provides that the first sharpening element is fixed within the case and the transition between first and second state is brought about by shifting the second sharpening element. This design makes it simple to operate the apparatus.

According to a preferred design it is provided that the case includes at least one aperture through which to insert the blades to be sharpened. This design enables a particularly user-friendly operation of the sharpening apparatus. Because the sharpening edges are disposed within a recess in the case, the user is better protected from injury.

An advantageous further development of the sharpening apparatus in accordance with the invention provides that for fixation of the positions of the sharpening elements with respect to one another and/or within the case there is provided a raster arrangement, in particular one with an externally visible display such as a scale. This arrangement prevents unintentional displacement of the sharpening elements, so that stable sharpening of the blades is possible.

However, the associated catch devices used for fixation of the sharpening element or elements can be intentionally released by a user in order to shift the element or elements into a new position, where they can again be arrested by a catch means and thus fixed in place. The raster arrangement can be so constructed that the sharpening elements are caught and fixed in position only when they are in certain prespecified orientations.

Alternatively or in addition, it is also possible for one or more devices, in particular one or more threaded spindles and/or sliders fixable by a screw means and/or gearings with toothed wheels and/or worm gears, preferably in each case with retention mechanisms, to be provided for the continuous adjustment of the sharpening elements with respect to one another and/or within the case, and for fixing them in the selected positions. With this design, no positions need to be prespecified, because the fact that shifting and fixation of the sharpening elements can be done continuously enables practically any arbitrary regions of the currently used sharpening edges to be selected for a sharpening process.

According to an advantageous embodiment of the invention the case of the sharpening apparatus is made flat, at least in sections, and/or is provided with feet and/or knobs so that it is stable when set onto a supporting surface. This can be complemented by provision of a table abutment on the case, in particular a stopping edge, which allows the apparatus to be arranged securely and stably and thereby enables a uniform sharpening process.

Furthermore, the case can be provided at least in sections with an anti-slip coating. As a result the placement of the apparatus on a support is stabilized and it is prevented from accidentally sliding away, which would be associated with a resulting risk of injury to the user by the blade that is being sharpened. An anti-slip coating can also ensure that the user can hold the apparatus safely and stably in his hand.

This last purpose is also served by a further development in which the case is constructed at least in part as a handle, for reliable manipulation of the apparatus by users. In this regard it is particularly useful for the handle to be equally suitable for right- and left-handed people.

To expand the functionality of the apparatus, according to one preferred design it can be provided that the apparatus includes an additional tool, in particular another sharpening tool. An apparatus for manual sharpening of the blades of cutting tools with this additional tool is also claimed independently of the sharpening apparatus described above.

It is useful for this additional tool to be constructed such that it can be used for freehand sharpening of all blades. Preferably, however, to obtain smooth cutting it is recommended that knives be sharpened with the tool described above, including a first and a second sharpening element.

The additional tool advantageously includes a sharpening element, in particular a sharpening element with the shape of a rectangular bar or ingot or trapezoid or triangle, that preferably can be turned around and/or exchanged for another element. It can also be provided that this sharpening element is slidable, preferably along its long direction, and in particular can be shifted at least partially into and out of the case.

As the material for all sharpening elements, a hard metal should primarily be considered.

Thus has been outlined, some features consistent with the present invention; however, the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

BRIEF DESCRIPTION OF THE DRAWINGS

In the following, the invention is explained in greater detail, also in regard to additional features and advantages, by a description of exemplary embodiments with reference to the attached drawings, wherein:

FIG. 1 is a schematic drawing of an exemplary embodiment of a sharpening apparatus according to the invention in plan view;

FIG. 1*a* shows the arrangement of the sharpening elements according to FIG. 1, in a schematic enlargement;

FIG. 2 shows the exemplary embodiment according to FIG. 1 in a side view.

DESCRIPTION OF INVENTION

Figure 3:
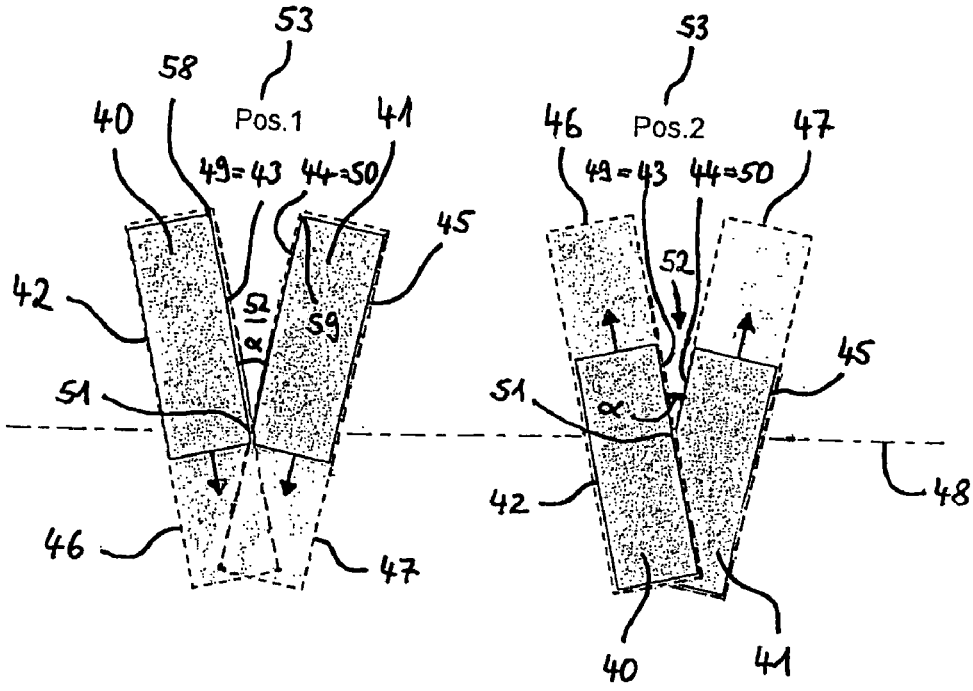
FIGS. 3, 4, 5, 6, 7*a, b, c*, and FIGS. 8*a, b* are diagrams of various embodiments of sharpening elements of a sharpening apparatus according to the invention.

FIGS. 1 and 2 show schematically an exemplary embodiment of a sharpening apparatus 10 in accordance with the invention; with FIG. 1 in plan view and FIG. 2 as seen from the side.

The sharpening apparatus 10 includes a case 11 with an upper surface 11*a*, which faces the observer in FIG. 1, and a lower surface 11*b* situated opposite the upper surface 11*a* (see FIG. 2). The case 11 has an elongated basic form so shaped and dimensioned that the sharpening apparatus can easily be manipulated by both right- and left-handed users. In particular, a middle region 12 of the case 11 has the form of a shaft or handgrip and is intended to be grasped by a user's hand. The middle region 12 of the case 11 of the sharpening apparatus 10 is thus a handle, i.e., holding part 13, of the sharpening apparatus 10. As a whole, the sharpening apparatus 10 is a hand tool that is portable and hence particularly versatile in use.

On the right side of FIG. 1, the sharpening apparatus 10 can be seen to include a first functional part 14. The first functional part 14 is a tool for sharpening smooth blades, for example those of knives. This tool is at least partially covered by a first head region 15 of the case 11. The first head region 15 of the case includes an aperture 16 so shaped that the case 11 forms a first tip 21 and a second tip 23, with a rim 22 of the first tip 21 directed toward the second tip 23 and a rim 24 of the second tip 23 directed toward the first tip 21. The tips 21, 23 have substantially the shape of sharp teeth with straight edges; only a rim 25 opposite the rim 24 of the lower tip 23 is rounded.

Within the aperture 16, FIG. 1 shows a first sharpening element 40. This first sharpening element 40 has an M shape and is fixed in position, so that it cannot move relative to the case 11. A second sharpening element 41 is also shown, which is shaped like a prism or an arrowhead. The regions of the sharpening elements 40, 41 that are covered by the case 11 are indicated by dashed lines. The configuration of the sharpening elements 40, 41 in FIG. 1 corresponds to that in the embodiment of these elements described below with reference to FIGS. 7*a,b,c* and 8*a,b*, so that reference is made thereto for further explanations regarding their arrangement, positioning, changes of position, actions and so on. Further details regarding the arrangement of the sharpening elements 40, 41 in FIG. 1 will next be explained with reference to FIG. 1*a*.

First a supplementary comment should be made with reference to FIG. 1, namely that the second sharpening element 41 is movable relative to the first sharpening element 40 and hence also to the case 11. FIG. 1 also shows the two angles $\alpha$, $\beta$ formed between the sharpening elements 40, 41.

FIG. 1*a* gives an enlarged view of the arrangement of the sharpening elements 40, 41 in FIG. 1 with no other parts such as the case 11 of the sharpening apparatus 10. The arrangement of the sharpening elements in FIG. 1*a* corresponds to that shown in FIG. 1, and FIG. 1*a* is also a plan view corresponding to the plan view in FIG. 1. The structures shown in FIG. 1*a* are the first sharpening element 40 and the second sharpening element 41; as seen here, the second sharpening element 41 is in front of the first sharpening element 40 and therefore obscures part of the first sharpening element 40. In these obscured sections, the first sharpening element 40 is drawn with dashed lines.

The reference numerals associated here with the sharpening elements 40, 41 correspond to those used for comparable components or regions in FIGS. 3 to 8*a,b*, which are discussed below. The sharpening elements 40, 41 can also be designed so that they can be exchanged.

In FIG. 1*a* it can be seen that the second sharpening element 41, in the form of an arrowhead or prism, includes a first sharpening edge 44 and a second sharpening edge 45. The M-shaped first sharpening element 40 comprises a first sharpening edge 42 and a second sharpening edge 43, these two sharpening edges 42, 43 being formed by the linear boundaries of the M shape that converge to form a V. The sharpening elements 40, 41 in FIG. 1*a* consist substantially of hard metal.

The second sharpening element 41 is slidably disposed in the case 11. This slidability is indicated by a double-headed arrow 60, and the position shown in the Figure, as made clear by a position line 62, represents the position of an outwardly directed point 63 of the second sharpening element 41. The marginal positions of the point 63 of the second sharpening element 41, i.e., those at the limits of the region within which the second sharpening element 41 can be shifted, are identified at the double-headed arrow 60 by "Pos. 1" and "Pos. 2", whereas "0" indicates the middle position. In the arrangement shown here the second sharpening element 41 has been pushed slightly away from the middle position "0", toward "Pos. 1".

The first sharpening edge 44 of the second sharpening element 41 and the first sharpening edge 42 of the first sharpening element 40 enclose the above-mentioned angle β. The second sharpening edge 45 of the second sharpening element 41 and the second sharpening edge 43 of the first sharpening element 40 enclose the angle α, likewise mentioned above. In FIGS. 1 and 1*a* the size of the angle β corresponds approximately to the size of the angle α, both angles α, β being about 40°.

On the basis of the position occupied in FIGS. 1 and 1*a* by the second sharpening element 41, the gap at the angle α, into which a blade to be sharpened must be inserted, is deeper than the corresponding gap at angle β. When the element is in the middle position "0" these gaps are equally deep, and in each of the marginal positions "Pos. 2" and "Pos. 2" one of the gaps is in its deepest possible state whereas the other gap vanishes completely, or at least nearly so (not shown in FIGS. 1 and 1*a*; cf. FIG. 8*a/b*).

The shifting of the second sharpening element 41 is brought about, as can be seen in FIG. 1, by means of a sliding button 28 that can move within a sliding region 29. In order to fix the second sharpening element 41 in the marginal positions "Pos. 2" and "Pos. 2", as well as in the middle position "0" and in other intermediate positions, an array of catches can be provided (not shown).

Alternatively, however, it is also possible for a worm gear (not shown) to be provided to shift the second sharpening element 41. The worm gear is self-fixing. Hence a catch array is not needed in this case; the second sharpening element 41 in every position it occupies is automatically fixed sufficiently for sharpening; that is, the second sharpening element 41 does not become displaced during the sharpening process.

FIG. 1*a* further shows schematically that the sharpening edges 42, 43, 44, 45 of both sharpening elements 40, 41 are relief-ground, forming a relief angle not shown here. This relief grinding is identified in FIG. 1*a* by the reference numeral 61. However, the relief grinding 61 in FIG. 1*a* is so disposed that it is concealed by the surfaces of the two sharpening elements 40, 41 that face the observer. Accordingly, the concealed relief grindings 61 are represented by dotted lines. The sharpening edges in FIGS. 1 and 1*a* are thus each adjacent to the surface of the associated sharpening element 40, 41 that faces toward the observer, and the relief grindings 61 face away from the observer. Accordingly, in FIG. 2 the sharpening edges are each situated on the side of the associated sharpening element that faces upward, i.e. toward the upper surface 11*a* of the case 11, whereas the relief grinding 61 is toward the underside 11*b* of the case 11.

On the left side as shown in FIG. 1, the sharpening apparatus 10 includes a second functional part 30. The second functional part 30 is a tool for sharpening blades of all kinds. It is suitable in particular, even for blades that are not easily accessible; for example, those of a kitchen slicer or in a mixer. However, it is also suitable for sharpening blades that cannot be sharpened with the first functional part 14, for example those with dimensions that are too large such as axe or scythe blades, or for processing the edges of skis. The second functional part is at least partly covered by a second head region 31 of the case 11.

The actual tool in the second functional part 30 is a sharpening element 32 substantially in the form of a rectangular bar or an ingot with several sharpening edges 33, which ordinarily consists substantially of hard metal. Alternatively the sharpening element 32 can also have a trapezoidal or triangular shape (not shown). The sharpening element 32 is slidably disposed in the case 11, in such a way that by means of a sliding button 34 it can be partially or completely pulled into the case 11 and can be pushed out of the case 11 for a sharpening procedure. Furthermore, the sharpening element 32 can be pushed out entirely, beyond a resistance point that preferably is reached about halfway along the distance over which the sharpening element 32 must move in order to emerge completely. Having been pushed out entirely, it can be used for sharpening by means of several edges and/or edge regions, so that an optimal sharpening result is achieved with an unused region and at the same time the useful life of the sharpening element 32 is increased. In addition, the sharpening element 32 can be exchanged.

In FIG. 1 two additional angles 39*a*, 39*b* are labeled, between the sharpening edges 33 and the case 11. These angled regions 39*a*, 39*b* facilitate the positioning and hence the sharpening of the blades to be processed. The magnitudes of the angles 39*a* and 39*b* are different in order to provide conditions suitable for as many kinds of blade as possible. For instance, the angle 39*a* can be about 90° while the angle 39*b* is about 120°. In case of an alternative configuration of the sharpening element 32, for example a trapezoidal or triangular configuration, the shape of the case 11 should be adapted thereto in such a way that again two different angles are formed between the sharpening edges and the case 11, for instance one angle of about 90° and another of about 120°. As a result, even with an alternative configuration of the sharpening element 32 it should be possible to apply to it a variety of blades to be sharpened.

The sharpening apparatus according to FIG. 1 and FIG. 2 is thus multifunctional. It is suitable for manual sharpening of cutting tools such as knives or scissors as well as for sharpening blades inserted into household devices such as kitchen slicers or mixers. Furthermore, it is also suitable for sharpening the edges of skis or blades with large dimensions, such as those of axes or scythes.

In order to enable optimal manipulation of the sharpening apparatus 10, the apparatus includes on the lower surface 11*b* of the case 11*a* flat surface 36, which is to be set onto a flat supporting structure. Furthermore, on the lower surface 11*b* of the case 11*a* stopping shoulder 38 is formed, which can be positioned for instance so that it abuts against the edge of a table, so as to enable stable manipulation of the sharpening apparatus 10. Next to the stopping shoulder 38 is an abutment section 37. To prevent the sharpening apparatus 10 from sliding out of position, the case 11 can be provided with an anti-slip coating on all or part of its surface.

The manual sharpening procedure that employs the functional part 14 of the sharpening apparatus 10 is preferably carried out by positioning the sharpening apparatus on a supporting structure, for example a table, and fixing it in position thereon, after which the blades to be sharpened are moved across the sharpening edges in the first functional part 14; that is, the blades are pulled through the functional part 14. Alternatively, however, it is also possible to keep the blade to be sharpened immobile, i.e., to fix it in position, and to move the functional part 14 of the sharpening apparatus 10 over the blade so that its sharpening edges make contact therewith.

The manual sharpening procedure that employs the functional part 30 of the sharpening apparatus 10 is preferably carried out by immobilizing or fixing in position the blade to be sharpened and pulling the sharpening edge 33 of the functional part 30 over the blade.

In this process care should be taken that the operative cutting edges on the sharpening elements are at all times turned towards the direction of movement of the blade to be sharpened; that is, the relief-ground section 61 is formed in the movement direction of the blades.

Accordingly, with an arrangement of the sharpening elements such as is shown in FIGS. 1 and 1*a*, the blades to be processed are moved into the plane of the drawing, i.e., from the upper surface 11*a* of the case 11 toward the lower surface 11*b* of the case 11. This corresponds to a movement of the blades from top to bottom in FIG. 2.

Figure 6:
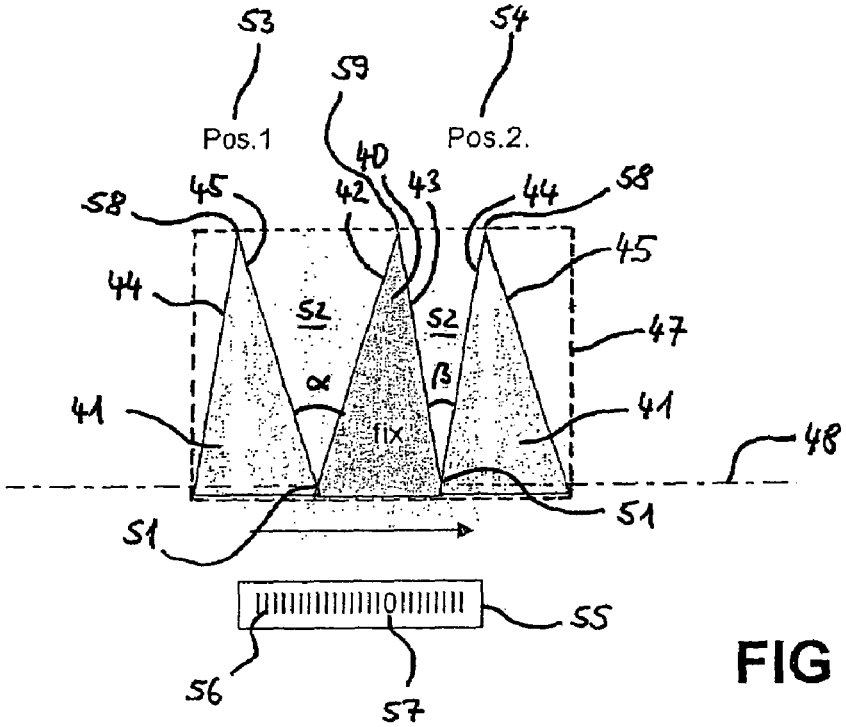
Figure 7A:
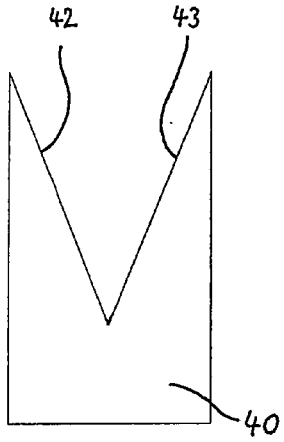
Figure 7B:
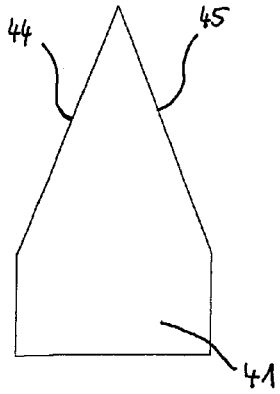
Figure 8A:
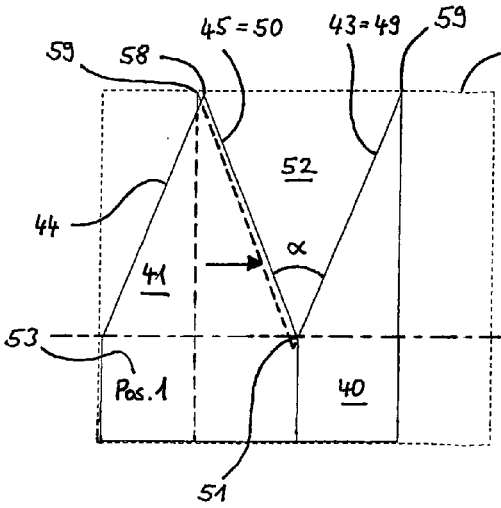

FIG. 3, FIG. 4, FIG. 5, FIG. 6, FIGS. 7*a,b,c* and FIGS. 8*a,b* are schematic drawings of various embodiments of sharpening elements in a sharpening apparatus in accordance with the invention. In each drawing the structures shown, and identified by the same reference numerals, are a first sharpening element 40 and a second sharpening element 41, both of which consist substantially of hard metal. The first sharpening element 40 includes a first sharpening edge 42 and a second sharpening edge 43. The second sharpening element 41 includes a first sharpening edge 44 and a second sharpening edge 45. Also represented in the Figures (if present in the particular embodiment), are shift regions identified by a dashed outline, namely a shift region 46 for the first sharpening element 40 and/or a shift region 47 for the second sharpening element 41. In each of the figures two marginal positions (Pos. 1 and Pos. 2) of the sharpening elements 40, 41 are indicated, between which the associated sharpening elements can be shifted. The direction in which it is possible for the first sharpening element 40 and/or the second sharpening element 41 to be shifted out of each of the positions shown is indicated by an arrow. The positioning of the sharpening elements 40, 41 relative to a case (not shown) of the sharpening apparatus is indicated by a baseline 48, which is the same for both of the marginal positions shown (Pos. 1 and Pos. 2) and therefore is continuous throughout each figure. This line is substantially parallel to a straight line defined by two outer limiting points 58, 59 of a V-shaped gap 52 (described below), which are situated opposite a crossing point 51. The baseline 48 is chosen such that it always intersects the deepest usable crossing point 51 of the sharpening elements 40, 41.

Figure 4:
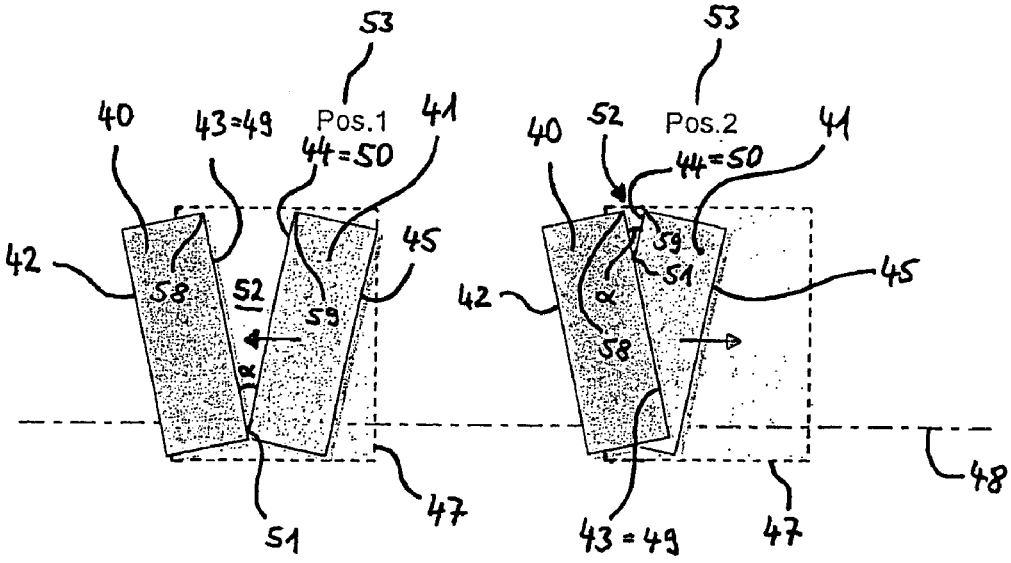
Figure 5:
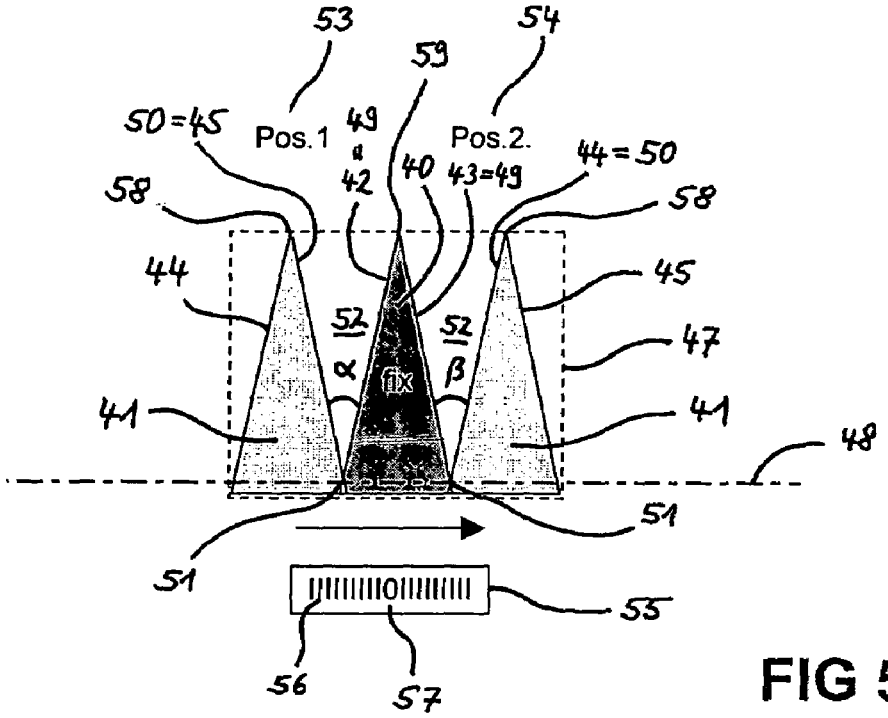

In each of the FIGS. 3, 4, 5, 6 and 8*a,b*, and in each of the marginal positions (Pos. 1 and Pos. 2), the first sharpening element 40 and second sharpening element 41 overlap to some extent: in FIG. 3 and FIG. 4 the first sharpening element 40 is in front of the second sharpening element 41, whereas in FIG. 5, FIG. 6 and FIGS. 8*a,b* the second sharpening element 41 is in front of the first sharpening element 40. A feature that cannot be seen in the figures is that the superimposed surface areas of the two sharpening elements 40, 41 are directly apposed—that is, they touch one another. However, it is also possible for a narrow gap to be left between these surfaces.

In FIG. 3 and FIG. 4, and in each of the marginal positions (Pos. 1 and Pos. 2) shown there, the second sharpening edge 43 of the first sharpening element 40 serves as a first currently used sharpening edge 49, and the first sharpening edge 44 of the second sharpening element 41 serves as a second currently used sharpening edge 50. The term "currently used" in both cases identifies the sharpening edge of the relevant element that is operative in the illustrated configuration. The first currently used sharpening edge 49 and the second currently used sharpening edge 50 cross one another at a crossing point 51, forming between them a V-shaped gap 52, with an angle $\alpha$ at the crossing point 51, into which blades of the cutting tools to be sharpened are inserted. The sharpening apparatus with sharpening elements 40, 41 arranged as shown in FIG. 3 or FIG. 4 is in a first state 53 of the sharpening apparatus while in both marginal positions (Pos. 1 and Pos. 2); that is, in both marginal positions the same sharpening edge of each sharpening element is being used for the sharpening procedure.

In FIG. 3 and FIG. 4, the basic shape of both the first sharpening element 40 and the second sharpening element 41 is a rectangle. The side surfaces are slanted (not shown); that is, the sharpening elements 40, 41 are relief-ground. The relief angle (not shown), i.e., the angle at which the side surfaces are slanted, is in the range from 4° to 10°. As a whole, therefore, each of the sharpening elements 40, 41 has the shape of an ingot. Furthermore, the first sharpening element 40 and the second sharpening element 41 have substantially the same dimensions.

The procedure for sharpening a blade with sharpening elements arranged as shown in FIG. 3 and FIG. 4 is carried out in each case in the region of the crossing point 51; that is, the sites or regions of the first currently used sharpening edge 49 and the second currently used sharpening edge 50 that are operative during this procedure are near the point 51, and hence it is here that wear occurs. FIGS. 3 and 4 show that the operative site (=region) of the currently used sharpening edges 49, 50 can be changed by shifting the sharpening elements 40, 41 in the directions indicated by the arrows in the drawings, so that many different sites along the currently used sharpening edges 49, 50 can be made operative for a sharpening procedure. If a site should become worn down, it is possible by simply shifting the sharpening elements 40, 41 to obtain an optimal result of sharpening at another, not yet worn site on the currently used sharpening edges 49, 50. This enables the currently used sharpening edges 49, 50 of the sharpening elements 40, 41 to be employed for sharpening blades over much or all of their length, and as a result the working life of the sharpening elements 40, 41 is distinctly prolonged.

With the arrangement shown in FIG. 3 the first sharpening element 40 can be shifted within the shift range 46, parallel to the first currently used sharpening edge 49, while the second sharpening element 41 can be shifted within the shift range 47, parallel to the second currently used sharpening edge 50. The two sharpening elements 40, 41 can be shifted individually or together. For any possible shifting of one or both of the sharpening elements 40, 41, the size of the angle α remains the same.

In FIG. 4 the first sharpening element 40 is fixed, whereas the second sharpening element 41 can be shifted parallel to the baseline 48, within the shift range 47. Here, again, the size of the angle α remains the same for all possible shifts of the second sharpening element 41.

In FIG. 5 and FIG. 6 the first sharpening element 40 and the second sharpening element 41 are each shaped like a prism or an arrowhead, with a triangle as the basic surface. In FIG. 5 the triangles formed by the two sharpening elements 40, 41 are both isosceles triangles, corresponding to one another. In contrast, the sharpening elements 40, 41 shown in FIG. 6 both have the shape of triangles with three unequal sides. In the case shown in FIG. 6, however, the two triangles formed by the sharpening elements 40, 41 have equal heights as well as equal bases. In all constructions shown here, all the side surfaces of the sharpening elements 40, 41 are slanted (not shown); that is, the sharpening elements 40, 41 exhibit relief grinding. The relief angle (not shown), i.e. the angle at which the side surfaces are slanted, is in the range from 4° to 10°.

In both FIG. 5 and FIG. 6 the first sharpening element 40 is fixed, whereas the second sharpening element 41 can be shifted parallel to the baseline 48, within the shift range 47. The two marginal positions in the shift range 47 that can be occupied by the second sharpening element 41 are designated "Pos. 1" and "Pos. 2". In "Pos. 1" the first sharpening edge 42 of the first sharpening element 40 constitutes a first currently used sharpening edge 49, and the second sharpening edge 45 of the second sharpening element 41 constitutes a second currently used sharpening edge 50. The first and second "currently used" sharpening edges are the sharpening edges that are operative during the sharpening process that is being considered. The first currently used sharpening edge 49 and the second currently used sharpening edge 50 cross one another at a crossing point 51, forming between them a V-shaped gap 52 with an angle α at the crossing point 51, into which blades of the cutting tools to be sharpened are inserted. The sharpening apparatus with sharpening elements 40, 41 arranged as shown in FIG. 5 or FIG. 6 is in a first state 53 while the marginal position "Pos. 1" is being occupied.

In the marginal position "Pos. 2" the second sharpening edge 43 of the first sharpening element 40 constitutes a first currently used sharpening edge 49, and the first sharpening edge 44 of the second sharpening element 41 constitutes a second currently used sharpening edge 50. Here, again, the first and second "currently used" sharpening edges are the sharpening edges that are operative during the sharpening process that is being considered. The first currently used sharpening edge 49 and the second currently used sharpening edge 50 likewise cross one another at a crossing point 51 when the apparatus is in "Pos. 2", forming between them a V-shaped gap 52 into which blades of the cutting tools to be sharpened are inserted, in this case with an angle β at the crossing point 51. The sharpening apparatus with sharpening elements 40, 41 arranged as shown in FIG. 5 or FIG. 6 is in a second state 54 while the marginal position "Pos. 2" is being occupied.

In FIGS. 5 and 6 the extent to which the second sharpening element 41 can be shifted is not only indicated by the outlined shift range 47; here a display device 55 is also provided. The shift range is subdivided by a raster arrangement, represented in the display device 55 by the scale lines 56. A shifted position such that the upper tip of the second sharpening element 41 coincides with the upper tip of the first sharpening element 40 is represented in the display device 55 by "0", reference numeral 57.

As long as the second sharpening element 41 occupies a position between the marginal position "Pos. 1" and the position "0" in FIG. 5 or FIG. 6, the sharpening apparatus is in the first state 53; that is, the same sharpening edges 42, 45 of the sharpening elements 40, 41 are always operative for the sharpening procedure. When the second sharpening element 41 is shifted within the region between the positions "Pos. 1" and "0", the size of the angle α remains the same. Thus the sharpening of a blade is always performed in the region of the crossing point 51; that is, the sites or regions of the first currently used sharpening edge 49 (=42) and the second currently used sharpening edge 50 (=45) located there are operative during a sharpening procedure, and therefore can be worn down. The operative site (=region) of each of the sharpening edges 42=49, 45=50 can be altered by shifting the sharpening element 41 between the marginal position "Pos. 1" and the position "0", as a result of which many different sites along the sharpening edges 42=49, 45=50 can be made operative for a sharpening procedure. If one site becomes worn, it is possible simply by shifting the second sharpening element 41 to operate at another, not yet worn-down site on the sharpening edges 42=49, 45=50 and thus obtain an optimal sharpening result. It therefore, becomes possible to use most or all of the length of the sharpening edges 42=49, 45=50 of the sharpening elements 40, 41 to sharpen blades, and thereby to distinctly prolong the working life of the sharpening elements 40, 41.

As long as the second sharpening element 41 occupies a position between the marginal position "Pos. 2" and the position "0" in FIG. 5 or FIG. 6, the sharpening apparatus is in the second state 54; that is, the same sharpening edges 43, 44 of the sharpening elements 40, 41 are always operative for the sharpening procedure. When the second sharpening element 41 is shifted within the region between the positions "Pos. 2" and "0", the size of the angle β remains the same. Thus the sharpening of a blade is always performed in the region of the crossing point 51; that is, the sites or regions of the first currently used sharpening edge 49 (=43) and the second currently used sharpening edge 50 (=44) located there are operative during a sharpening procedure, and therefore can be worn down. The operative site (=region) of each of the sharpening edges 43=49, 44=50 can be altered by shifting the sharpening element 41 between the marginal position "Pos. 2" and the position "0", as a result of which many different sites along the sharpening edges 43=49, 44=50 can be made operative for a sharpening procedure. If one site becomes worn, it is possible simply by shifting the second sharpening element 41 to operate at another, not yet worn-down site on the sharpening edges 43=49, 44=50 and thus obtain an optimal sharpening result. It therefore, becomes possible to use most or all of the length of the sharpening edges 43=49, 44=50 of the sharpening elements 40, 41 to sharpen blades, and thereby to distinctly prolong the working life of the sharpening elements 40, 41.

The fact that the second sharpening element 41 in FIG. 5 and FIG. 6 can be shifted throughout the range delimited by the marginal positions "Pos. 1" and "Pos. 2" thus makes it possible, without structural modification of the sharpening elements, to make use of both sharpening edges 42, 43 of the first sharpening element 40 as well as both sharpening edges 44, 45 of the second sharpening element 41. As a result, the working life of the sharpening elements 40, 41 is again prolonged.

In FIG. 5 the two angles α and β are equally large because the sharpening elements 40, 41 are both shaped as isosceles triangles, so that in both the first state 53 and the second state 54 the sharpening apparatus can be used to sharpen blades with comparable cutting-edge angles.

In FIG. 6, on the other hand, the two angles α and β are of different sizes, angle α being distinctly larger than angle β. Hence when the apparatus is in the first state 53, it can sharpen blades having a cutting-edge angle distinctly different from that of blades that can be sharpened when the apparatus is in the second state 54. Also, in the case of a two-phase blade, the two phases of the blade can be processed in sequence, inasmuch as the phase with the smaller angle is sharpened when the sharpening apparatus is in the second state 54, after which the apparatus is converted to the first state 53 in order to sharpen the phase with the larger angle.

In particular the embodiment according to FIG. 6, with sharpening elements 40, 41 shaped, arranged and shiftable as illustrated there, enables an especially flexible and multifunctional design of a sharpening apparatus or sharpening tool. For this purpose the sharpening elements 40, 41 are disposed in a case, for example a case constructed like the one in the embodiment according to FIGS. 1 and 2, in such a way that the second sharpening element 41 can be shifted therein over a range corresponding to the shift range 47 in FIG. 6 with associated marginal positions "Pos. 1" and "Pos. 2", and the first sharpening element 40 is fixed within the case.

The embodiment of the sharpening elements according to FIG. 6 is thus designed to enable sharpening of two different groups of blades. These groups differ with respect to the angle at the cutting edge. This embodiment is also suitable for sharpening both phases of a two-phase blade.

Another embodiment is illustrated by both FIGS. 7*a,b,c* and FIGS. 8*a,b*. As shown there, the first sharpening element 40 has a three-dimensional M shape, with an M-shaped basic surface (see FIG. 7*a*), and the second sharpening element 41 is shaped like prism or arrowhead, with a basic surface in which a triangle and a rectangle are combined (see FIG. 7*b*). The height is the same for both sharpening elements 40, 41. Here, again, the side surfaces of the sharpening elements 40, 41 that are adjacent to the sharpening edges 42, 43, 44, 45 are all slanted (not shown), i.e., the sharpening elements 40, 41 exhibit a relief grinding. The relief angle (not shown), i.e., the angle at which the side surfaces are slanted, is in the range from 4° to 10°.

Figure 7C:
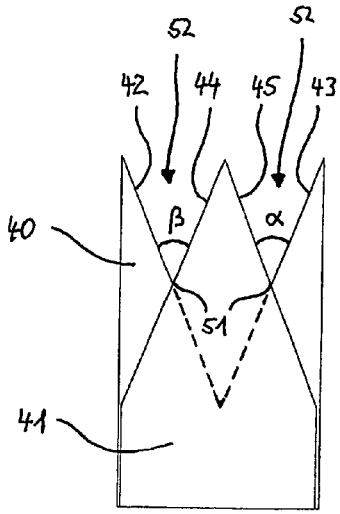
Figure 8B:
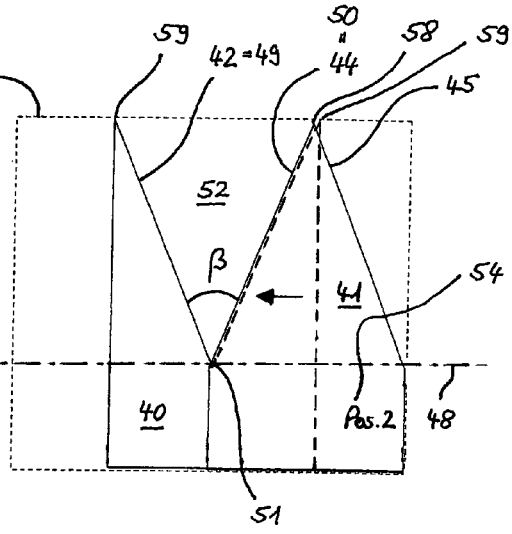

FIG. 7*c* and FIGS. 8*a,b* show the arrangement of the sharpening elements 40, 41 with respect to one another; the second sharpening element 41 is disposed in front of the first sharpening element 40, and the edges of the first sharpening element 40 thus concealed are represented by dashed lines. The first sharpening element 40 is fixed in position, whereas the second sharpening element 41 can be shifted parallel to the baseline 48 within the shift range 47. The two marginal positions, i.e., the outermost positions that can be occupied by the second sharpening element 41 within the shift range 47, are shown in FIG. 8*a* and FIG. 8*b*, respectively, and identified as "Pos. 1" and "Pos. 2". In the marginal position "Pos. 1" (FIG. 8*a*) the second sharpening edge 43 of the first sharpening element 40 constitutes a first currently used sharpening edge 49, and the second sharpening edge 45 of the second sharpening element 41 constitutes a second currently used sharpening edge 50. The first and second "currently used" sharpening edges are the sharpening edges that are operative during the sharpening process that is being considered. The first currently used sharpening edge 49 and the second currently used sharpening edge 50 cross one another at a crossing point 51, forming between them a V-shaped gap 52 with an angle α at the crossing point 51, into which blades of the cutting tools to be sharpened are inserted. The sharpening apparatus with sharpening elements 40, 41 arranged as shown in FIG. 8*a* is in a first state 53 while the marginal position "Pos. 1" is being occupied.

In the marginal position "Pos. 2" (FIG. 8*b*) the first sharpening edge 42 of the first sharpening element 40 constitutes a first currently used sharpening edge 49, and the first sharpening edge 44 of the second sharpening element 41 constitutes a second currently used sharpening edge 50. Here, again, the first and second "currently used" sharpening edges are the sharpening edges that are operative during the sharpening process that is being considered. The first currently used sharpening edge 49 and the second currently used sharpening edge 50 likewise cross one another at a crossing point 51 when the apparatus is in "Pos. 2", forming between them a V-shaped gap 52 into which blades of the cutting tools to be sharpened are inserted, but in this case with an angle β at the crossing point 51. The sharpening apparatus with sharpening elements 40, 41 arranged as shown in FIG. 8*b* is in a second state 54 while the marginal position "Pos. 2" is being occupied.

FIG. 7*c* shows an intermediate position of the second sharpening element 41 relative to the first sharpening element 40. This intermediate position is between the marginal positions "Pos. 1" and "Pos. 2" shown in FIGS. 8*a,b*. It can be seen that in the intermediate position all four sharpening edges 42, 43, 44, 45 of the sharpening elements 40, 41 are usable and hence are operative for a sharpening procedure; that is, between the sharpening edges 42 and 44 as well as between the sharpening edges 43 and 45 a V-shaped gap 53 is formed into which blades of the cutting tools to be sharpened can be inserted. The angles α and β, respectively, are shown in FIG. 7*c*.

At every position to which the the second sharpening element 41 can be shifted between the marginal positions "Pos. 1" and "Pos. 2", therefore, the sharpening apparatus is simultaneously in the first state 53 and the second state 54; that is, all sharpening edges 42, 43, 44, 45 of the sharpening elements 40, 41 are always available to be used for a sharpening procedure. When the second sharpening element 41 is shifted within the shift range 47, the sizes of the angles α and β continue to be equal. With this arrangement the procedure for sharpening a blade is always carried out in the region of the crossing point 51; that is, the sites or regions along the associated sharpening edges 42, 43, 44, 45 are operative during a sharpening process and hence are subject to being worn down. The operative site (=region) of the sharpening edges 42, 43, 44, 45 can be altered by shifting the sharpening element 41 between the marginal positions "Pos. 1" and "Pos. 2", as a result of which many different sites along the sharpening edges 42, 43, 44, 45 can be made operative for sharpening. If one site becomes worn, it is possible simply by shifting the second sharpening element 41 to operate at another, not yet worn-down site on the sharpening edges 42, 43, 44, 45 and thus obtain an optimal sharpening result. It therefore becomes possible to use most or all of the length of the sharpening edges 42, 43, 44, 45 of the sharpening elements 40, 41 to sharpen blades, and thereby to distinctly prolong the working life of the sharpening elements 40, 41.

In FIGS. 7*a,b,c* and FIGS. 8*a,b* the two angles α and β are equally large; that is, in both the first state 53 and the second state 54 of the sharpening apparatus blades with comparable cutting angles can be sharpened. It is possible, however, by constructing the sharpening elements 40, 41 appropriately to make the sizes of the angles α and β different, so that blades with distinctly different cutting angles—i.e., blades belonging to a different cutting-angle size class—can be optimally sharpened at the most suitable angle, α or β.

It is self-evident that the other embodiments, possibilities for shifting and arrangements of the sharpening elements 40, 41 according to FIG. 3, FIG. 4, FIG. 5, FIG. 6, FIGS. 7*a,b,c* and FIGS. 8*a,b* can also be disposed in appropriately adapted cases 11 (cf. FIGS. 1 and 2), so as in each case to construct sharpening tools. Variations and modifications may be made to the above-described embodiments of the invention without departing from the spirit and principles of the invention.

What is claimed is:

1. An apparatus for the manual sharpening of blades of cutting tools, in particular knives and/or scissors, comprising:

at least one first sharpening element with at least one sharpening edge, and at least one second sharpening element with at least one sharpening edge, wherein the first sharpening element and the second sharpening element can be or are disposed so as to be partially overlapping, in particular partially in contact with one another, such that in a first state of the apparatus one sharpening edge of the first sharpening element defines a first currently used sharpening edge and one sharpening edge of the second sharpening element defines a second currently used sharpening edge, and the first currently used sharpening edge and second currently used sharpening edge cross one another at a crossing point and form a V-shaped gap with an angle α at the crossing point, into which the blade of the cutting tool to be sharpened is inserted;

wherein the first sharpening element and the second sharpening element can be shifted with respect to one another while maintaining the angle α, such that the crossing point is shifted along the first currently used sharpening edge and/or the second currently used sharpening edge; and two or more positionings of the sharpening elements with respect to one another are or can be reversibly fixed;

wherein the apparatus comprises a case in which the first sharpening element and the second sharpening element are or can be disposed;

such that the first sharpening element and/or the second sharpening element can be shifted relative to the case; and such that two or more positionings of the sharpening elements with respect to one another in the case are or can be reversibly fixed.

2. The apparatus according to claim 1, wherein at least one sharpening edge of the first sharpening element and/or at least one sharpening edge of the second sharpening element is made at least in part rectilinear.

3. The apparatus according to claim 1, wherein at least one sharpening edge of the first sharpening element and/or at least one sharpening edge of the second sharpening element is constructed as a relief-ground sharpening edge.

4. The apparatus according to claim 1, wherein a display device is provided to indicate the positioning of the first sharpening element and/or the second sharpening element in or on the case.

5. The apparatus according to claim 1, wherein the first sharpening element and/or the second sharpening element are/is shaped like an ingot.

6. The apparatus according to claim 1, wherein the case is constructed so as to be flat at least in sections and/or is provided with feet and/or knobs, so as to ensure that it can be placed stably on a supporting surface, and/or is provided at least in sections with an anti-slip coating.

7. The apparatus according to claim 1, wherein the apparatus comprises one or more additional tools, in particular a sharpening tool.

8. The apparatus according to claim 7, wherein the additional tools comprise a sharpening element, in particular one having a shape of one of a rectangular bar, an ingot, a trapezoid, a triangle, that preferably can be rotated and/or exchanged for another tool, and/or that can be shifted, preferably along its long direction, in particular can be shifted at least partially into and out of the case.

9. An apparatus for the manual sharpening of blades of cutting tools, in particular knives and/or scissors, comprising:

at least one first sharpening element with at least one sharpening edge, and at least one second sharpening element with at least one sharpening edge, wherein the first sharpening element and the second sharpening element can be or are disposed so as to be partially overlapping, in particular partially in contact with one another, such that in a first state of the apparatus one sharpening edge of the first sharpening element defines a first currently used sharpening edge and one sharpening edge of the second sharpening element defines a second currently used sharpening edge, and the first currently used sharpening edge and second currently used sharpening edge cross one another at a crossing point and form a V-shaped gap with an angle α at the crossing point, into which the blade of the cutting tool to be sharpened is inserted;

wherein the first sharpening element and the second sharpening element can be shifted with respect to one another while maintaining the angle α, such that the crossing point is shifted along the first currently used sharpening edge and/or the second currently used sharpening edge; and two or more positionings of the sharpening elements with respect to one another are or can be reversibly fixed;

wherein the first sharpening element and/or the second sharpening element are/is shaped like an ingot; and wherein the first sharpening element and/or the second sharpening element can be shifted parallel to the associated first currently used sharpening edge or second currently used sharpening edge.

10. An apparatus for the manual sharpening of blades of cutting tools, in particular knives and/or scissors, comprising:

at least one first sharpening element with at least one sharpening edge, and at least one second sharpening element with at least one sharpening edge, wherein the first sharpening element and the second sharpening element can be or are disposed so as to be partially overlapping, in particular partially in contact with one another, such that in a first state of the apparatus one sharpening edge of the first sharpening element defines a first currently used sharpening edge and one sharpening edge of the second sharpening element defines a second currently used sharpening edge, and the first currently used sharpening edge and second currently used sharpening edge cross one another at a crossing point and form a V-shaped gap with an angle α at the crossing point, into which the blade of the cutting tool to be sharpened is inserted;

wherein the first sharpening element and the second sharpening element can be shifted with respect to one another while maintaining the angle α, such that the crossing point is shifted along the first currently used sharpening edge and/or the second currently used sharpening edge; and two or more positionings of the sharpening elements with respect to one another are or can be reversibly fixed;

wherein the first sharpening element and/or the second sharpening element are/is shaped at one end to form a prism or an arrowhead, with a triangle as a basic surface.

11. An apparatus for the manual sharpening of blades of cutting tools, in particular knives and/or scissors, comprising:

at least one first sharpening element with at least one sharpening edge, and at least one second sharpening element with at least one sharpening edge, wherein the first sharpening element and the second sharpening element can be or are disposed so as to be partially overlapping, in particular partially in contact with one another, such that in a first state of the apparatus one sharpening edge of the first sharpening element defines a first currently used sharpening edge and one sharpening edge of the second sharpening element defines a second currently used sharpening edge, and the first currently used sharpening edge and second currently used sharpening edge cross one another at a crossing point and form a V-shaped gap with an angle α at the crossing point, into which the blade of the cutting tool to be sharpened is inserted;

wherein the first sharpening element and the second sharpening element can be shifted with respect to one another while maintaining the angle α, such that the crossing point is shifted along the first currently used sharpening edge and/or the second currently used sharpening edge; and two or more positionings of the sharpening elements with respect to one another are or can be reversibly fixed;

wherein the first sharpening element has a three-dimensional M shape and/or the second sharpening element is shaped at least at one end to form a prism or an arrowhead with a triangle as basic surface.

12. An apparatus for the manual sharpening of blades of cutting tools, in particular knives and/or scissors, comprising:

at least one first sharpening element with at least one sharpening edge, and at least one second sharpening element with at least one sharpening edge, wherein the first sharpening element and the second sharpening element can be or are disposed so as to be partially overlapping in particular partially in contact with one another, such that in a first state of the apparatus one sharpening edge of the first sharpening element defines a first currently used sharpening edge and one sharpening edge of the second sharpening element defines a second currently used sharpening edge, and the first currently used sharpening edge and second currently used sharpening edge cross one another at a crossing point and form a V-shaped gap with an angle α at the crossing point, into which the blade of the cutting tool to be sharpened is inserted;

wherein the first sharpening element and the second sharpening element can be shifted with respect to one another while maintaining the angle α, such that the crossing point is shifted along the first currently used sharpening edge and/or the second currently used sharpening edge; and two or more positionings of the sharpening elements with respect to one another are or can be reversibly fixed;

wherein the first sharpening element and/or the second sharpening element can be shifted substantially parallel to a straight line defined by two outer points that delimit the V-shaped gap and are situated opposite the crossing point.

13. An apparatus for the manual sharpening of blades of cutting tools, in particular knives and/or scissors, comprising:

at least one first sharpening element with at least one sharpening edge, and at least one second sharpening element with at least one sharpening edge, wherein the first sharpening element and the second sharpening element can be or are disposed so as to be partially overlapping, in particular partially in contact with one another, such that in a first state of the apparatus one sharpening edge of the first sharpening element defines a first currently used sharpening edge and one sharpening edge of the second sharpening element defines a second currently used sharpening edge, and the first currently used sharpening edge and second currently used sharpening edge cross one another at a crossing point and form a V-shaped gap with an angle α at the crossing point, into which the blade of the cutting tool to be sharpened is inserted;

wherein the first sharpening element and the second sharpening element can be shifted with respect to one another while maintaining the angle α, such that the crossing point is shifted along the first currently used sharpening edge and/or the second currently used sharpening edge; and two or more positionings of the sharpening elements with respect to one another are or can be reversibly fixed;

wherein the first sharpening element and second sharpening element each comprise at least one additional sharpening edge, which is rectilinear at least in part, and the apparatus can be put into a second state that differs from the first state inasmuch as in the second state the additional sharpening edge of the first sharpening element constitutes the first currently used sharpening edge and the additional sharpening edge of the second sharpening element constitutes the second currently used sharpening edge, and the V-shaped gap forms an angle β at the crossing point.

14. The apparatus according to claim 13, wherein the apparatus in the first state and the second state are simultaneously available.

15. The apparatus according to claim 13, wherein the transition between a first state and second state is brought about by shifting the first sharpening element and/or the second sharpening element.

16. The apparatus according to claim 15, wherein the first sharpening element is fixed in the case and the transition between a first state and a second state is brought about by shifting the second sharpening element.

17. An apparatus for the manual sharpening of blades of cutting tools, in particular knives and/or scissors, comprising:

at least one first sharpening element with at least one sharpening edge, and at least one second sharpening element with at least one sharpening edge, wherein the first sharpening element and the second sharpening element can be or are disposed so as to be partially overlapping, in particular partially in contact with one another, such that in a first state of the apparatus one sharpening edge of the first sharpening element defines a first currently used sharpening edge and one sharpening edge of the second sharpening element defines a second currently used sharpening edge, and the first currently used sharpening edge and second currently used sharpening edge cross one another at a crossing point and form a V-shaped gap with an angle $\alpha$ at the crossing point, into which the blade of the cutting tool to be sharpened is inserted;

wherein the first sharpening element and the second sharpening element can be shifted with respect to one another while maintaining the angle $\alpha$, such that the crossing point is shifted along the first currently used sharpening edge and/or the second currently used sharpening edge; and two or more positionings of the sharpening elements with respect to one another are or can be reversibly fixed;

wherein in order to fix the sharpening elements in the selected positions with respect to one another and/or within the case a raster arrangement, in particular with a display device, is provided, and/or one or more devices, in particular one or more threaded spindles and/or screw-arrestable sliders and/or toothed-wheel gearings and/or worm gears, preferably in each case with a stopping device, is or are provided for continuously adjusting the positions of the sharpening elements with respect to one another and/or in the case and fixing them in the selected positions.

* * * * *